US009066403B2

(12) United States Patent
Neser et al.

(10) Patent No.: US 9,066,403 B2
(45) Date of Patent: Jun. 23, 2015

(54) LED LAMP WITH HALF WAVE DIMMING

(71) Applicant: GE Lighting Solutions, LLC, Shelton, CT (US)

(72) Inventors: Morne Neser, Montreal (CA); Louis Bacon, Laval (CA); Truong-Khoa Nguyen, St. Laurent (CA); Christian Poirier, Montreal (CA)

(73) Assignee: GE LIGHTING SOLUTIONS, LLC, East Cleveland, OH (US)

( * ) Notice: Subject to any disclaimer, the term of this patent is extended or adjusted under 35 U.S.C. 154(b) by 350 days.

(21) Appl. No.: 13/623,899

(22) Filed: Sep. 21, 2012

(65) Prior Publication Data

US 2013/0134903 A1 May 30, 2013

Related U.S. Application Data

(60) Provisional application No. 61/564,662, filed on Nov. 29, 2011.

(51) Int. Cl.
*G05F 1/00* (2006.01)
*H05B 33/08* (2006.01)

(52) U.S. Cl.
CPC ..... *H05B 33/0854* (2013.01); *Y10T 29/49117* (2015.01); *H05B 33/0815* (2013.01)

(58) Field of Classification Search
USPC ..... 315/119, 127, 177, 185 R, 186, 192, 315/193, 200 R, 201, 209 R, 210, 224, 247, 315/250, 253, 254, 276, 282, 287, 291, 297, 315/299, 306, 307, 308, 312, 313, 362, 315/DIG. 4
See application file for complete search history.

(56) References Cited

U.S. PATENT DOCUMENTS

| | | | | |
|---|---|---|---|---|
| 4,293,796 | A | 10/1981 | McMorrow | |
| 5,783,909 | A | 7/1998 | Hochstein et al. | |
| 6,276,822 | B1 * | 8/2001 | Bedrosian et al. | 362/545 |
| 6,486,616 | B1 | 11/2002 | Liu et al. | |
| 7,321,203 | B2 | 1/2008 | Marosek et al. | |
| 7,352,138 | B2 | 4/2008 | Lys et al. | |
| 7,378,805 | B2 | 5/2008 | Oh et al. | |

(Continued)

FOREIGN PATENT DOCUMENTS

| | | |
|---|---|---|
| EP | 1128711 | 8/2006 |
| EP | 1502483 | 12/2008 |

(Continued)

OTHER PUBLICATIONS

PCT Search Report and Written Opinion dated Feb. 14, 2013 from corresponding Application No. PCT/US2012/061315.

*Primary Examiner* — Douglas W Owens
*Assistant Examiner* — Jianzi Chen
(74) *Attorney, Agent, or Firm* — GE Global Patent Operation; Peter T. Dimauro

(57) ABSTRACT

An LED lamp assembly includes a power supply configured to receive an input power signal and provide a DC lamp current, a dimming controller coupled to the power supply and configured to adjust the DC lamp current, and an LED lamp coupled to the DC lamp current. The dimming controller is configured to determine if full brightness or dimmed brightness is required based at least in part on the input power signal. The DC lamp current is maintained at a first level when full brightness is required and at a second level when dimmed brightness is required.

14 Claims, 3 Drawing Sheets

(56) References Cited

U.S. PATENT DOCUMENTS

| | | | | |
|---|---|---|---|---|
| 7,528,554 | B2 | 5/2009 | Chitta et al. | |
| 7,557,521 | B2 | 7/2009 | Lys et al. | |
| 7,737,643 | B2 | 6/2010 | Lys et al. | |
| 7,759,881 | B1 | 7/2010 | Melanson | |
| 7,898,187 | B1 | 3/2011 | Mei et al. | |
| 2007/0182338 | A1 | 8/2007 | Shteynberg et al. | |
| 2008/0048582 | A1 | 2/2008 | Robinson et al. | |
| 2009/0184662 | A1 | 7/2009 | Given et al. | |
| 2010/0060192 | A1 | 3/2010 | Ferro | |
| 2011/0043129 | A1 | 2/2011 | Koolen et al. | |
| 2011/0062887 | A1 | 3/2011 | Hsu et al. | |
| 2011/0148318 | A1 | 6/2011 | Shackle et al. | |
| 2012/0032604 | A1* | 2/2012 | Hontele | 315/201 |
| 2012/0286696 | A1* | 11/2012 | Ghanem | 315/291 |

FOREIGN PATENT DOCUMENTS

| | | |
|---|---|---|
| WO | 9750168 | 12/1997 |
| WO | 2007106123 | 9/2007 |
| WO | 2008025153 | 3/2008 |
| WO | 2008053501 | 5/2008 |
| WO | 2009081423 | 7/2009 |

* cited by examiner

LED LAMP WITH HALF WAVE DIMMING

CROSS-REFERENCE TO RELATED APPLICATIONS

This application claims priority to, and the benefit of, U.S. Provisional Patent Application Ser. No. 61/564,662, filed on 29 Nov. 2011, the disclosure of which is incorporated herein by reference in its entirety.

BACKGROUND

1. Field of the Invention

The aspects of the present disclosure relate generally to traffic signals and in particular to LED signal lamps.

2. Description of Related Art

In recent years, there has been a great deal of effort directed towards developing lighting systems that use less electrical power. A significant amount of energy is wasted by present commercial traffic control lighting systems when operated at a single level of power. The high light output typically required for visibility during daylight operation greatly exceeds that which is required for visibility during the night hours. The high light output used during daylight hours can also create excessive amounts of glare when used during nighttime operation leading to unsafe driving conditions. To overcome these problems, street traffic controllers have been developed that are capable of controlling the light level of signal lights such that full brightness is used during daylight hours, and a dimmed, more energy efficient and less glaring, light level is used during nighttime.

Early street traffic controllers that included dimming capabilities were designed for use with incandescent signal lamps. These older incandescent signal lamps typically operated directly off the local mains power, such as the 110 volt 60 Hertz grid power available in North America. A common approach used to dim incandescent signal lamps is to include a load switch in the controller that supplies full-wave mains voltage when full brightness is desired and to supply half-wave rectified mains voltage when a dimmed brightness is required. With typical prior art incandescent signal lamps this approach provides full brightness when the full-wave power is applied and about 70% brightness when half wave rectified power is applied.

Replacing incandescent signal lamps with Light Emitting Diode (LED) light sources, also known as LED Lights or LED lamps, can provide significant reductions in the amount of electricity consumed by traffic signaling applications. In addition to improvements in power consumption, LED signal lamps provide better reliability, lower heat generation, improved vibration resistance, and longer lifetime. LED replacement lamps typically comprise an array of individual LED elements arranged in a circular pattern so the unit is the same size as an incandescent signal lamp.

It is expensive, and can take extended periods of time, to replace the entire signaling system, including controller, wiring, and light fixtures, with signaling systems designed for use with LED lamps. An attractive alternative to replacing the entire system is to create LED replacement signal lamps that are both physically and electrically compatible with current incandescent signal lamp standards allowing the more efficient and reliable LED replacement lamps to be retrofit directly into older systems without making any other changes to the older systems. This also allows gradual upgrade of older systems by installing an LED replacement lamp each time an older incandescent lamp burns out. The LED light elements used in these replacement signal lamps require low level DC power, typically around 12 volts DC. Therefore, small switching power supplies are typically included in the LED replacement signal lamp assemblies to convert the AC mains voltage supplied by the existing traffic control system into the low level DC voltage required by the LED light elements. Unfortunately, the switching power supplies used in the LED replacement lamps need only a small amount of input power and consequently produce the same light level from both full-wave and half-wave rectified supply power. Thus, the dimming capabilities of the existing street traffic controllers are nullified by the LED replacement lamps. Therefore, there exists a need for LED replacement signal lamps that provide dimming capabilities similar to incandescent lamps.

Accordingly, it would be desirable to provide a system that addresses at least some of the problems identified above.

SUMMARY

As described herein, the exemplary embodiments overcome one or more of the above or other disadvantages known in the art.

One aspect of the exemplary embodiments relates to an LED lamp assembly. In one embodiment, the LED lamp assembly includes a power supply configured to receive an input power signal and provide a DC lamp current, a dimming controller coupled to the power supply and configured to adjust the DC lamp current, and an LED lamp coupled to the DC lamp current. The dimming controller is configured to determine if full brightness or dimmed brightness is required based at least in part on the input power signal. The DC lamp current is maintained at a first level or amount when full brightness is required and at a second level when dimmed brightness is required.

Another aspect of the disclosed embodiments relates to a method of controlling the brightness of an LED lamp. In one embodiment, the method includes sampling an input power signal, determining whether the input power signal contains a half-wave signal, measuring a zero-level duration of the input power signal, comparing the zero-level duration to a predetermined threshold duration value, and maintaining the LED lamp at a full brightness if the zero-level duration is not greater than the threshold duration time or the input power signal does not contain a half-wave signal.

A further aspect of the disclosed embodiments is directed to a method of retrofitting traffic control signals that contain incandescent signal lamps with dimmable energy saving LED signal lamps. In one embodiment, the method includes creating a dimmable LED lamp assembly wherein the dimmable LED lamp assembly is configured to produce a full brightness when a full-wave power signal is applied and to produce a dimmed brightness when a half-wave rectified power signal is applied, packaging the dimmable LED lamp assembly such that it is physically and electrically compatible with the incandescent signal lamps, and replacing each incandescent signal lamp with the packaged dimmable LED lamp assembly.

DETAILED DESCRIPTION OF THE DISCLOSED EMBODIMENTS

Figure 1:
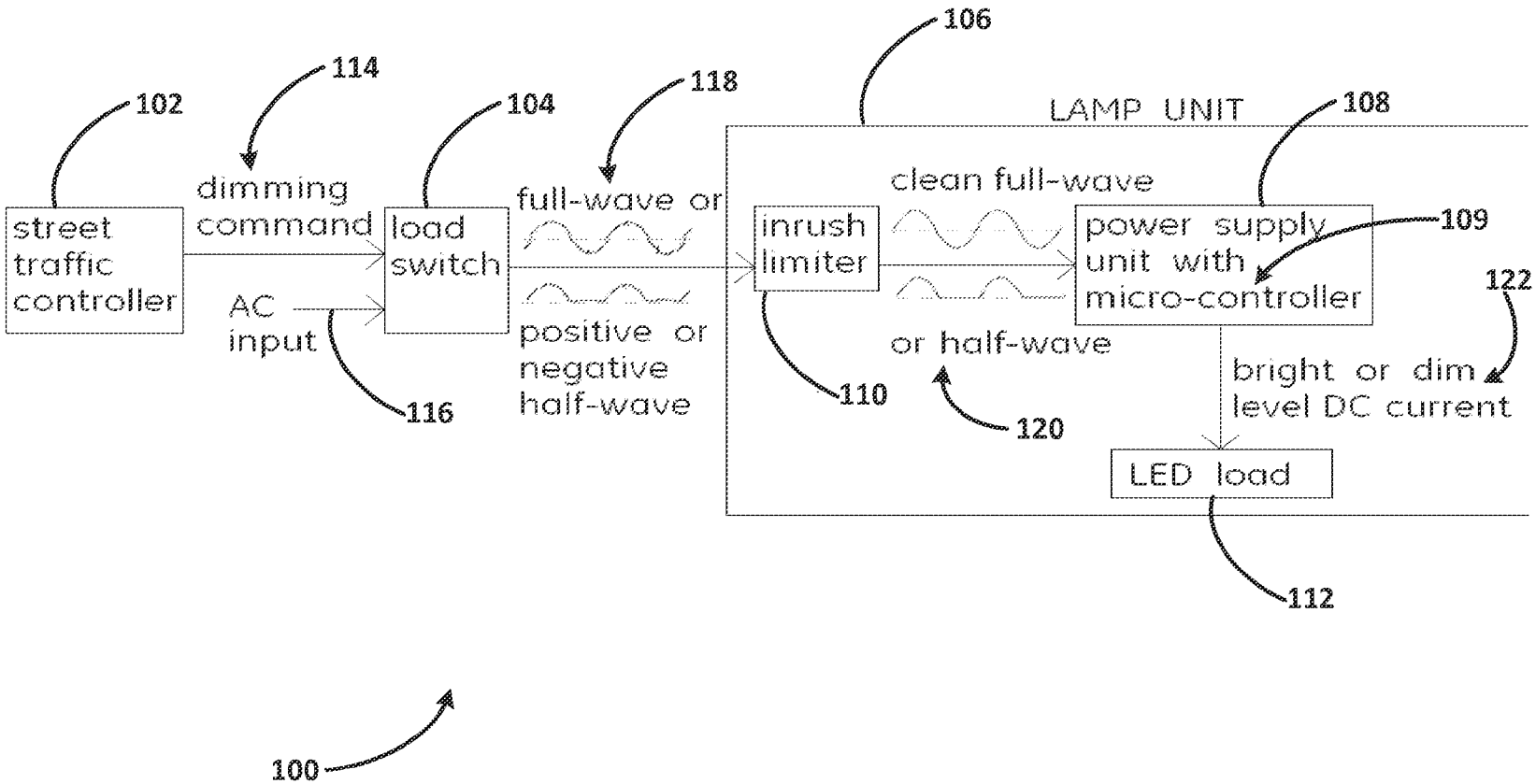
FIG. 1 illustrates a block diagram of a traffic lighting control system having an LED signal lamp incorporating aspects of the present disclosure.

Referring to FIG. 1, a block diagram of an exemplary traffic lighting or signaling system 100 in accordance with aspects of the disclosed embodiments is shown. The aspects of the disclosed embodiments are directed to an LED signal lamp unit that has electrical characteristics compatible with existing standards for incandescent signal lamps and provides dimmable operation when retrofit into existing traffic signaling systems that use full-wave or half-wave rectified power to control brightness of the lamp. The LED lamp unit 106 with the inrush limiter 110 and dimming controller 109 can detect when dimmed brightness is required and adjust the light output of the LED load 112 accordingly. Although aspects of the disclosed embodiments are generally described herein with respect to a traffic signaling lamp, the disclosed embodiments are not so limited and may be advantageously employed in other applications requiring dimming control of LED lamps as well.

The LED lamp unit assembly 106 of the disclosed embodiments generally includes an LED Load 112, a power supply unit 108, which in one embodiment includes a dimming controller 109, and an inrush limiter 110. The dimming controller 109 generally includes, is coupled to, or is in communication with, a microcontroller that includes a processor and is operable to detect when the input lamp power signal 118 supplied from the load switch 104 is a half-wave power signal or a full-wave power signal and apply a selected dimmed or bright DC current level 122 to the LED load 112 accordingly. In one embodiment, the dimming controller 109 is comprised of a microcontroller and machine-readable instructions that are executable by a processing device contained in the microcontroller. The microcontroller can comprise a small general purpose computer typically constructed on a single integrated circuit or small circuit board containing a processor, memory, and programmable input/output peripherals. In some embodiments the microcontroller includes an analog-to-digital converter, digital-to-analog converter, and/or on board counters that can be used as frequency counters etc. Alternatively, the dimming controller can include analog and/or digital circuits that are constructed to make the dimmed or full brightness determination and provide a signal to control the DC current supplied to the LED load 112 by the power conditioning components. Those skilled in the art will easily recognize that various combinations of microcontrollers, processing devices, analog circuits, and digital circuits can be used to construct the dimming controller 109 without straying from the spirit and scope of the present disclosure.

The LED load 112 is generally comprised of an array of individual LED light elements arranged in a circle similar in size to an incandescent signal lamp. The exemplary lamp unit assembly 106 conforms to the same electrical and physical standards required of incandescent signal lamps and therefore may be retrofit directly into a typical street traffic control system comprising a street traffic controller 102 and a load switch 104. The street traffic control system shown in FIG. 1 provides dimming control of lamp units by applying full-wave power when full brightness is desired and half-wave rectified power when a reduced brightness is desired. The exemplary LED lamp unit assembly 106 detects changes in applied power and adjusts the brightness of the LED load 112 accordingly.

As shown in FIG. 1, the exemplary traffic signaling system 100 comprises a typical street traffic controller 102 to provide a dimming command signal 114. The dimming command signal 114 alternates between one of three states to turn the lamp unit 106 off, operate the lamp unit 106 at a dimmed brightness, or operate the lamp unit 106 at full brightness. The dimming control signal 114 is applied to a load switch 104 to control and generate the lamp power signal 118. The load switch 104 receives AC input power 116 and produces the lamp power signal 118 based in part on the dimming command signal 114. The AC input power 116 is typically supplied by the local mains power grid and may comprise the 120 volt, 60 Hertz power available in the United States, 50 Hertz 230 volt power available in many European countries, or other suitable AC power sources. When the dimming control signal 114 indicates an off state, the lamp power signal 118 generated by the load switch 104 is indicative of a no power state. When the dimming command signal 114 indicates that the lamp unit 106 should be turned on at a dimmed light level, the lamp power signal 118 generated by the load switch 104 is half-wave rectified AC input power, referred to herein as a half-wave power signal. When the dimming control signal 114 indicates that the lamp unit 106 should be turned on at full brightness, the load switch 104 applies the AC input power 116 directly to the lamp unit 106 with no rectification. This is referred to herein as a full-wave power signal. Typical traffic signaling systems include a street traffic controller 102 and a load switch 104 and produce a lamp power signal 118 as described above. By configuring the lamp unit 106 to be physically as well as electrically compatible with typical traffic signaling systems the new, more efficient and longer life, lamp unit 106 can be easily retrofit into existing traffic signaling systems.

The lamp unit assembly 106 receives the lamp power signal 118 from the signal load switch 104 and uses this lamp power signal 118 to power both its internal components such as the power supply unit 108 and dimming controller 109, as well as the LED load 112. The dimming controller 109 monitors the lamp power signal 118 to determine the required lamp brightness level. The lamp unit 106 also detects whether the lamp power signal 118 comprises a half-wave rectified AC power signal or a full-wave AC power signal and is operative to control the brightness of the LED load 112 accordingly.

The lamp power signal 118 is received in the lamp unit 106 by the inrush limiter 110. The inrush limiter 110 is coupled between the lamp power signal 118 and the power supply unit 108 and controls and limits current going into the power supply 108 to protect internal components of the lamp unit 106 from damage. The power supply unit 108 can include energy storage components that draw large currents when power is first applied to them. These large currents are referred to as inrush currents. The magnitude of the initial inrush currents can exceed safe limits of various components and reduce the lifespan of the lamp unit 106. The inrush limiter 110 is configured to limit the inrush current and any other current spikes that may be present. Limiting the current is accomplished by preventing the magnitude, or amount, of the current flowing into or out of the power supply, from exceeding a predetermined amount, thereby avoiding damage to the various components in the power supply unit 108. An amount or value of current as used herein refers to a quantity of electric current, such as a number of amperes of current. An additional benefit of the inrush limiter 110 is that it is also configured to filter out noise and higher harmonic distortions that may be contained in the lamp power signal 118. Cost is typically a consideration when designing a load switch such as the load switch 104 and typical load switches can often produce very noisy and distorted lamp power 118. The inrush limiter 110 filters the lamp power 118 thereby producing a substantially "clean" power signal 120, i.e. a signal that has relatively low noise and low harmonic distortion.

As shown in FIG. 1, the power signal 120 from the inrush limiter is transmitted to the power supply unit 108. The power supply unit 108 receives the power signal 120 and produces a lamp current 122 for lighting the LED load. In one embodiment, the power supply unit 108 can comprise various power conditioning components such as for example a bridge rectifier, switching regulator, power factor controller, electromagnetic compliance filter, isolation transformer, output rectifier and/or output filter (not shown). A skilled artisan will easily recognize that any power supply unit 108 that is capable of converting the power signal 120 into a DC lamp current 122 is within the spirit and scope of the disclosure. The power supply unit 108 is configured to maintain at least two different levels of DC lamp current 122. A first level, or amount, of lamp current will produce a bright light output from the LED load 112, and a second level, or amount, of lamp current will produce a dimmed light output from the LED load 112.

The dimming controller 109 may be included in the power supply unit 108 or alternatively may be a separate unit coupled to the power supply unit 108. In either configuration the dimming controller 109 is configured to control the power supply unit 108, such that the DC lamp current 122 is maintained at a bright or dimmed amount. In one embodiment, the dimming controller 109 includes a microcontroller configured to analyze the power signal 120 to determine whether the street traffic controller 102 requires full brightness or dimmed brightness. When the street traffic controller requires full brightness it sends a dimming control signal 114 to the load switch 104 that indicates full brightness. This causes the load switch 104 to produce a full-wave power signal 118 that is provided to the power supply unit 108 as a clean full-wave power signal 120. When the street traffic controller 102 requires a dimmed LED light output, it produces a dimming control signal 114 that indicates a dimmed light output, resulting in a half-wave power signal 120 being provided to the power supply unit 108. The dimming controller 109 monitors the power signal 120 to determine if full brightness or dimmed brightness is required, and adjusts the power supply 108 to produce a lamp current 122 necessary to achieve the required brightness. As will be described in more detail below, the dimming controller 109 monitors the frequency of zero-level detection triggers created from the power signal 120 and measures the period and duration of zero-level occurrences in order to determine whether full or dimmed brightness is required.

Figure 2:
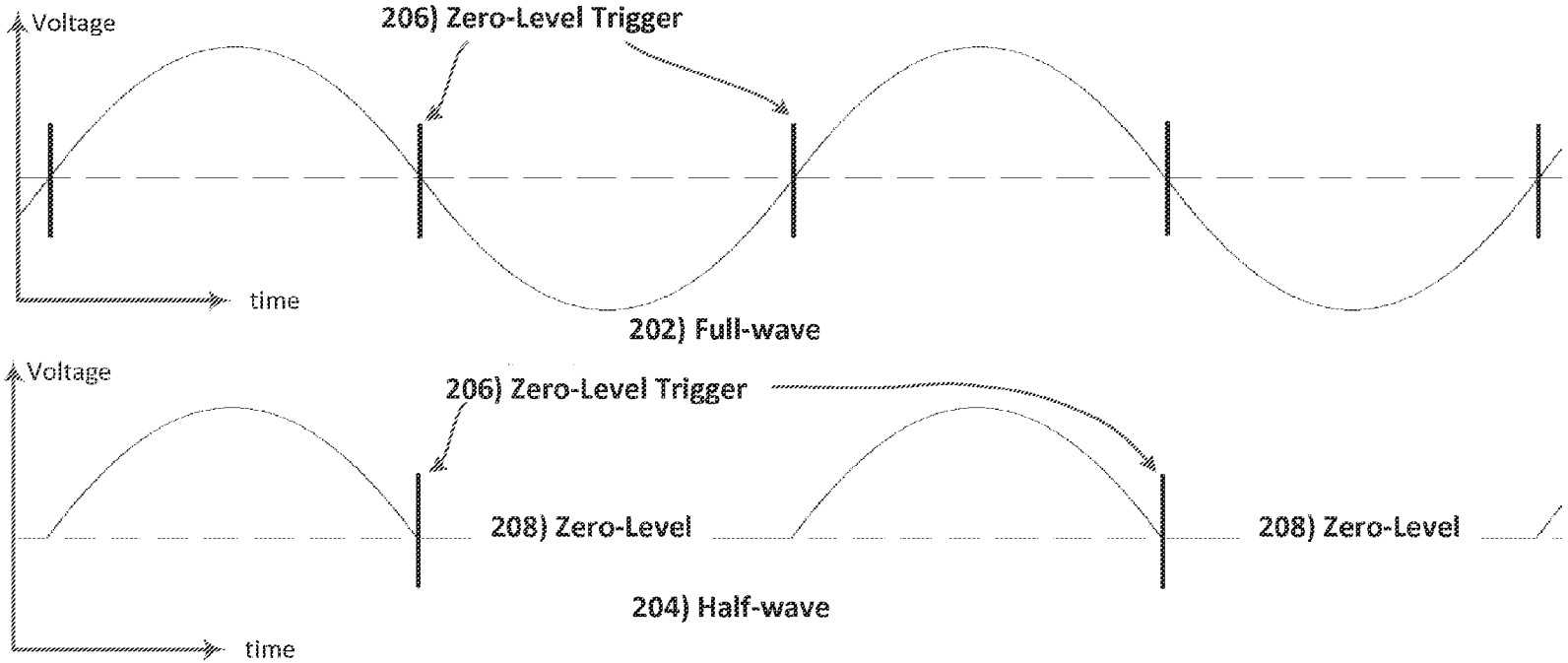
FIG. 2 illustrates graphs showing full-wave and half-wave power signals that can be used in a traffic lighting control system incorporating aspects of the present disclosure.

FIG. 2 illustrates exemplary power signals 120, shown as a full-wave power signal 202 and a half-wave power signal 204. These graphs show voltage along the vertical axis and time along the horizontal axis. Referring to FIGS. 1 and 2, the power signal 120 is received by the power supply unit 108 which generates a load current 122, and is also used by the dimming controller 109 to determine whether full brightness or dimmed brightness is required by the traffic control system 100. As described above, when full brightness is required, the load switch 104 provides a full-wave power signal 120 to the lamp unit 106 as is shown by the full-wave power signal 202. When dimmed brightness is required, the half-wave power signal 204 is provided to the lamp unit 106. The normally supplied full-wave 202 power signal 120 is between about 50 Hz to about 60 Hz (cycles per second) depending on the frequency of the AC input 116 which is typically connected to the local power grid. This full-wave 202 power signal 120 generates a series of zero-level detection triggers 206 at a rate of about 100 to 120 Hz. The detection triggers 206 are at a rate of about 100 Hz when 50 Hz grid power is supplied and at a rate of about 120 Hz when 60 Hz grid power is supplied. The half-wave power signal 204 generates zero-level detection triggers 206 at a rate of about 50 Hz to about 60 Hz, or about half the rate at which the full-wave power signal generates them. A threshold frequency level between 60 Hz to 100 Hz, such as 80 Hz for example, can be used to distinguish between a full-wave 202 and a half-wave 204 power signal 120. By measuring the frequency, or alternatively the period where the period is the reciprocal of frequency, of the series of zero-level detection triggers 206 generated by the supply voltage, it can be predicted if the power signal 120 is a full-wave 202 or half-wave 204 power signal. In addition, the instantaneous supplied voltage level of the power signal 120 is measured to detect when a prolonged zero-level 208 is present in each cycle. Measuring the duration of the zero-level and including this measurement when making a brightness determination improves the reliability of the full-wave or half-wave prediction.

In one embodiment, the power supply unit 108 includes a circuit (not shown) that generates zero-level trigger pulses 206 each time the power signal goes to zero. These zero-level trigger pulses 206 are input to a microcontroller included in the dimming controller 109, where a determination about the required dimming level is made. In certain embodiments a circuit, such as a counter circuit, is used to measure the period between trigger pulses and the period is provided to a microcontroller, or alternatively, the power signal 120 can be provided directly to the microcontroller as a digitized power signal, such as for example by an analog-to-digital converter, and the microcontroller can be configured to locate the zero-crossing triggers 206 itself to help make the full or dimmed brightness determination. In one embodiment, the microcontroller is also configured to monitor the amount of time the power signal 120 remains at the zero-level 208. The duration of the zero-level 208 may be obtained either by instructions executed in the microcontroller or by other circuits contained in the dimming controller 109 which provide the measured duration to the microcontroller. As will be described in more detail below, the power supply unit 108 uses the frequency of occurrence of the zero-level triggers 206 and the duration of the zero-level 208 to make its determination regarding full or dimmed brightness.

Figure 3:
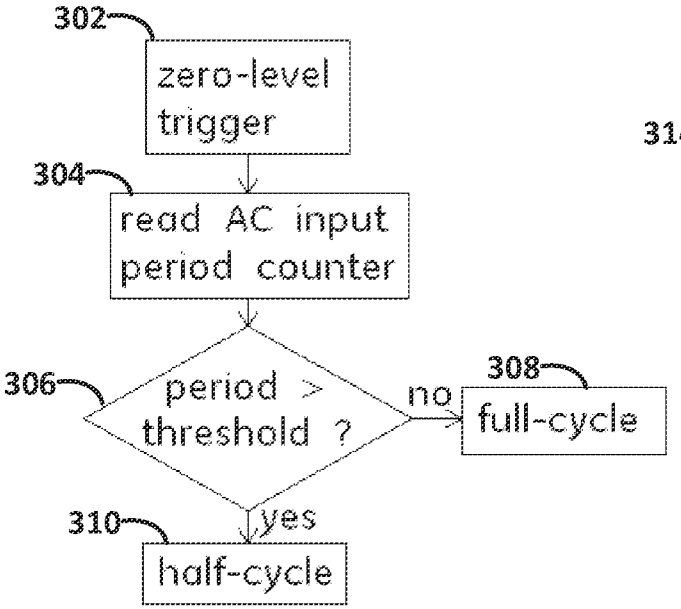
FIG. 3 illustrates an exemplary method that may be used to detect a full-wave or half-wave power signal in a traffic lighting control system incorporating aspects of the present disclosure.
Figure 4:
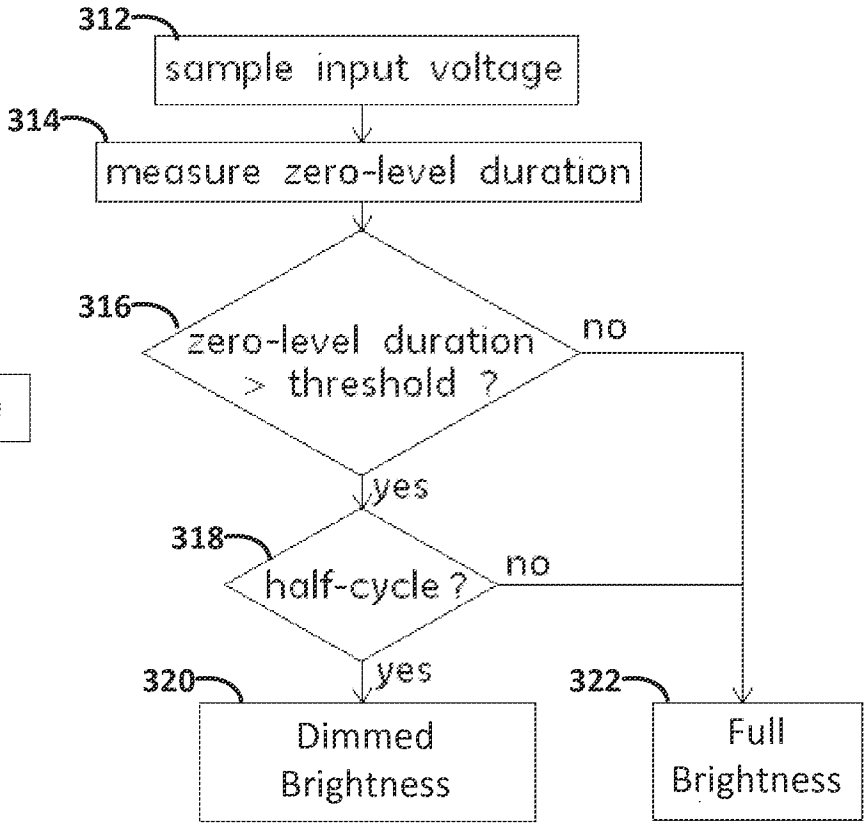
FIG. 4 illustrates an exemplary method that may be used to set a signal lamp to full or dimmed brightness in a traffic lighting control system incorporating aspects of the present disclosure.

As described above with respect to FIG. 1, when the traffic signal controller 102 requires full brightness, a full-wave power signal is applied to the lamp unit 106, and when the controller 102 requires dimmed brightness a half-wave power signal is applied to the lamp unit 106. Thus the exemplary lamp unit monitors the applied power signal 118 and sets the lamp brightness accordingly. FIGS. 3 and 4 illustrate exemplary embodiments of a method for determining whether the lamp unit, 106 in FIG. 1, should be set to full brightness or dimmed brightness. The exemplary method shown in FIG. 3 determines 306 if the power signal 118 applied to the lamp unit 106 is a full-wave or half-wave power signal. The exemplary method illustrated in FIG. 4 uses the result of the half-wave/full-wave determination 306 along with the zero-level duration 316 to determine if the lamp unit 106 should be at full brightness or at dimmed brightness. Referring to FIGS. 2 and 3, the series of zero-level triggers 206 is received 302 and a counter is used to determine 304 the period between zero-level triggers 206. It is often the case where the time between each pair of zero-level triggers in the series of zero-level triggers is not constant. In such a situation certain embodiments may average or use other techniques to remove noise and other instabilities from the period measurement. The measured period is then compared 306 to a threshold value to make a determination as to whether the power signal is a full-wave or full cycle power signal 308, i.e. the period is not greater than the threshold value, or a half-wave power signal 310, i.e. the period is greater than the threshold value. The determination of whether the power signal 120 is a full-wave signal 308 or a half-wave signal 310, will then be used to make a full brightness/dimmed brightness determination. Typical grid power frequencies are 50 Hz or 60 Hz, however any AC input power frequency can be accommodated by adjusting the threshold values used to evaluate the zero-level duration and zero-level trigger period.

FIG. 4 illustrates one embodiment of a method that may be used to make a full brightness/dimmed brightness determination. To begin the determination, samples of the input voltage are taken 312. The input voltage may be the analog input power signal 118 which is received from the load switch 104 or alternatively it may be a digital representation of the analog power signal as may be created using an analog to digital converter. The samples generally comprise the instantaneous voltage of the power signal at periodic intervals. The samples are used to measure 314 the zero-level duration 208. With reference to FIG. 2, the zero-level duration 208 is the amount of time the power signal 118 remains at or near zero volts. The zero-level duration 208 is then compared 316 to a threshold duration time. When the zero-level duration 208 is not greater than the threshold time, then the power signal is likely a full-wave signal and the lamp unit 106 should be at full brightness 326. When the zero-level duration 208 is greater than the threshold time then it is possible that the power signal 118 is a half-wave signal and the result of the period determination 306 is considered. If a half-wave determination 310 was made, then the lamp unit 106 is set to dimmed brightness 320, otherwise the lamp unit 106 is set to full brightness 322. Thus, when both the period of the triggers and the zero-level duration are greater than their respective threshold times, 306, 316, 318, then it is most likely the power signal is a half-wave signal indicating the traffic controller requires dimmed brightness and the dimming controller 109 sets the lamp unit 106 to dimmed brightness 320.

In one embodiment, the processes illustrated in FIGS. 3 and 4 are in the form of instructions stored in memory of a microcontroller, or other computing device and are executed by a processor of the microcontroller or other computing device. In alternate embodiments, the processes of FIGS. 3 and 4 may be performed by analog and digital circuits or some combination of analog and digital circuits, and microcontroller instructions.

Thus, while there have been shown, described and pointed out, fundamental novel features of the invention as applied to the exemplary embodiments thereof, it will be understood that various omissions and substitutions and changes in the form and details of devices illustrated, and in their operation, may be made by those skilled in the art without departing from the spirit of the invention. Moreover, it is expressly intended that all combinations of those elements and/or method steps, which perform substantially the same function in substantially the same way to achieve the same results, are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An LED lamp assembly, the assembly comprising:

a power supply configured to receive an input power signal and provide a DC lamp current;

a dimming controller coupled to the power supply and configured to adjust the DC lamp current; and an LED lamp coupled to the DC lamp current, wherein the dimming controller is configured to determine if full brightness or dimmed brightness is required based at least in part on the input power signal, and to maintain the DC lamp current at a first amount when full brightness is required and to maintain the DC lamp current at a second amount when dimmed brightness is required by:

determining whether the input power signal contains a half-wave signal;

measuring a zero-level duration of the input power signal; and maintaining the LED lamp current at the first amount when the zero-level duration is not greater than a predetermined threshold time or the input power signal does not contain a half-wave signal; or maintaining the LED lamp current at the second amount when the zero-level duration is greater than the predetermined threshold time and the input power signal contains a half-wave signal.

2. The LED lamp assembly according to claim 1, comprising an inrush limiter coupled between the input power signal and the power supply, wherein the inrush limiter is configured to prevent an inrush current from exceeding a predetermined amount.

3. The LED lamp assembly according to claim 2, wherein the inrush limiter is further configured to filter and clean the input power signal.

4. The LED lamp assembly according to claim 1, wherein the LED lamp comprises one or more LED elements.

5. The LED lamp assembly according to claim 1, wherein the LED lamp assembly is configured to be physically and electrically compatible with current incandescent signal lamps.

6. The LED lamp assembly according to claim 1, wherein determining whether the input power signal contains a half-wave signal comprises:

generating a series of zero level-triggers from the input power signal;

measuring a period between each pair of zero-level trigger in the series of zero-level triggers; and determining that the input power signal contains a half-wave signal when the period is greater than a threshold time.

7. The LED lamp assembly according to claim 1, wherein the dimming controller comprises an analog-to-digital converter, a processor and a memory, and is further configured to:

provide a digitized power signal from the input power signal by sampling the input power signal with an analog-to-digital converter;

measure a zero-level duration of the digitized power signal;

maintain the LED lamp current at the first amount if the zero-level duration is not greater than a predetermined threshold time or the input power signal does not contain a half-wave signal; and maintain the LED lamp current at the second amount if the zero-level duration is greater than the predetermined threshold time and the input power signal contains a half-wave signal.

8. The LED lamp assembly according to claim 7, wherein determining whether the input power signal contains a half-wave signal comprises:

generating a series of zero level-triggers from the digitized power signal;

measuring a period between each pair of zero-level triggers in the series of zero-level triggers; and determining that the input power signal contains a half-wave signal when the period is greater than a threshold time.

9. A method of controlling the brightness of an LED lamp, the method comprising:

sampling an input power signal;

determining whether the input power signal contains a half-wave signal;

measuring a zero-level duration of the input power signal;

comparing the zero-level duration to a predetermined threshold duration value; and maintaining the LED lamp at a full brightness if the zero-level duration is not greater than the threshold duration time or the input power signal does not contain a half-wave signal.

10. The method according to claim 9, further comprising maintaining the LED lamp at a dimmed brightness if the zero level duration is greater than the threshold duration time and the input power signal contains a half-wave signal.

11. The method according to claim 10, wherein determining whether the input signal contains a half-wave signal comprises:

generating a series of zero level-triggers from the input power signal;

measuring a period between each pair of zero-level triggers in the series of zero-level triggers; and determining that the input power signal contains a half-wave signal when the period is greater than a threshold time.

12. The method according to claim 10, wherein the input power signal is a digital signal and sampling an input power signal comprises:

receiving an analog power signal;

converting the analog power signal to a digital input power signal using an analog-to-digital converter; and sampling the digital input power signal to create the input power signal.

13. A method of retrofitting traffic control signals that contain incandescent signal lamps with dimmable energy saving LED signal lamps, the method comprising:

providing a dimmable LED lamp assembly wherein the dimmable LED lamp assembly is configured to produce a full brightness when a full-wave power signal is applied and to produce a dimmed brightness when a half-wave rectified power signal is applied;

packaging the dimmable LED lamp assembly such that it is physically and electrically compatible with the incandescent signal lamps; and replacing each incandescent signal lamp with the packaged dimmable LED lamp assembly.

14. The method of claim 13, wherein the dimmable LED lamp assembly comprises:

a power supply configured to receive an input power signal and provide a DC lamp current;

a dimming controller coupled to the power supply and configured to adjust the DC lamp current; and an LED lamp coupled to the DC lamp current, wherein the dimming controller is configured to determine if full brightness or dimmed brightness is required based at least in part on the input power signal, and to maintain the DC lamp current at a first amount when full brightness is required and to maintain the DC lamp current at a second amount when dimmed brightness is required.

* * * * *